US011075493B2

(12) United States Patent
Lin et al.

(10) Patent No.: US 11,075,493 B2
(45) Date of Patent: Jul. 27, 2021

(54) ELECTRICAL CONNECTOR

(71) Applicant: Topconn Electronic (Kunshan) Co., Ltd, Kunshan (CN)

(72) Inventors: Sanyo Lin, Kunshan (CN); Fu Su, Kunshan (CN); Maoshan Chen, Kunshan (CN); Kai Wu, Kunshan (CN)

(73) Assignee: STARCONN ELECTRONIC (Su Zhou) Co., LTD, Kunshan (CN)

( * ) Notice: Subject to any disclaimer, the term of this patent is extended or adjusted under 35 U.S.C. 154(b) by 0 days.

(21) Appl. No.: 16/787,058

(22) Filed: Feb. 11, 2020

(65) Prior Publication Data

US 2020/0381883 A1 Dec. 3, 2020

(30) Foreign Application Priority Data

May 31, 2019 (CN) ..... 201910473091.3

(51) Int. Cl.
*H01R 33/76* (2006.01)
*H01R 12/71* (2011.01)
*H01R 107/00* (2006.01)

(52) U.S. Cl.
CPC ..... *H01R 33/7635* (2013.01); *H01R 12/712* (2013.01); *H01R 33/765* (2013.01); *H01R 2107/00* (2013.01)

(58) Field of Classification Search
CPC ..... H01R 33/7635; H01R 33/765; H01R 12/712; H01R 2107/00
See application file for complete search history.

(56) References Cited

U.S. PATENT DOCUMENTS 7,604,502 B2 * 10/2009 Pan ..... H01R 13/6585 439/607.08
7,785,148 B2 * 8/2010 Pan ..... H01R 13/514 439/607.06
7,905,751 B1 * 3/2011 Davis ..... H01R 13/6587 439/607.05
10,784,630 B1 * 9/2020 Chen ..... H01R 13/6597
2009/0149065 A1 * 6/2009 Pan ..... H01R 23/688 439/607.13
2009/0170373 A1 * 7/2009 Pan ..... H01R 13/6582 439/607.36

(Continued)

*Primary Examiner* — Abdullah A Riyami
*Assistant Examiner* — Nader J Alhawamdeh
(74) *Attorney, Agent, or Firm* — Gang Yu

(57) ABSTRACT

The application provides an electrical connector, which includes: an insulating body; a conductive body; and a plurality of grounding terminals and a plurality of signal terminals. A plurality of L-shaped protrusions are arranged on the conductive body, a row of L-shaped protrusions are formed between every two adjacent terminal rows, the L-shaped protrusion includes a short edge portion and a long edge portion, the short edge portion is electrically connected to the corresponding grounding terminal by a second end of the short edge portion, and the long edge portion isolates a part of differential signal terminal pairs in adjacent terminal rows that are at least partially overlapped in the column direction. By such electrical connector, the differential signal terminal pairs may be shielded well to avoid crosstalk interference, a common-ground effect is achieved between the grounding terminals, and overall operational effectiveness of the electrical connector is effectively improved.

20 Claims, 12 Drawing Sheets

(56) References Cited

U.S. PATENT DOCUMENTS

2009/0233471 A1* 9/2009 Pan ..... H01R 12/712
439/108
2015/0194771 A1* 7/2015 Pan ..... H01R 13/6587
439/607.1

* cited by examiner

ELECTRICAL CONNECTOR

CROSS-REFERENCE TO RELATED APPLICATION

This application claims priority to and the benefit of Chinese Patent Application No. 2019104730913, filed on May 31, 2019, the entire contents of which are incorporated herein by reference.

TECHNICAL FIELD

The application relates to an electrical connector, and more particularly to an electrical connector for signal transmission, which may prevent or reduce crosstalk generated during a signal transmission of the electrical connector.

BACKGROUND

In an electronic or communication system, circuits and electronic modules are usually arranged on some separated printed circuit boards, and these separated printed circuit boards are connected to each other by electrical connectors. An electrical connector implements connection of a backplane and each daughterboard. Along with constantly increase of bandwidth requirements from users, more and more circuits have been arranged in a specified narrow region of each printed circuit board and work at increasing frequencies. Correspondingly, an electrical connector between printed circuit boards transmits data at an increasing rate, and a signal transmission rate has reached 6 Gbps and even 10 Gbps or higher. Such a high-speed and high-density connection requires a high requirement on a signal integrity (SI) performance index, particularly a numerical value of a crosstalk index, of the electrical connector.

In order to preventing such crosstalk, efforts have been made to a certain extent in prior arts. For example, an electrical connector is provided in Patent Application No. CN205863449U, the electrical connector includes a conductive plastic for connecting grounding terminals, and a plurality of linearly arranged rectangular blocks are arranged between adjacent terminal rows to form shields between two differential signal terminal pairs adjacent to the rectangular blocks. However, since the conductive plastic is formed integrally with a U-shaped plastic body by a secondary injection molding manner, and due to differences between material characteristics, a preparation process is complex and unfavorable for mass production. In a preparation and forming process of the conductive plastic, extension of the linear rectangular block in a length direction may not be excessively increased for enhancement of a shielding effect under the limit of spaces of a mold and the U-shaped plastic body, and this is because excessive extension of the rectangular block in the length direction may cause a corresponding rectangular groove in the corresponding U-shaped plastic body excessively long, thereby reduce structural stability of the U-shaped plastic body.

In view of this, the application discloses an electrical connector to overcome the shortcomings.

SUMMARY

The application is intended to provide an electrical connector, which may prevent or reduce crosstalk generated during a signal transmission of the electrical connector.

The application provides an electrical connector, which includes: an insulating body; a conductive body, located relative to the insulating body; and a plurality of grounding terminals and a plurality of signal terminals connected to the insulating body in an array, wherein every two adjacent signal terminals in a row direction of the array form a differential signal terminal pair, the differential signal terminal pairs and the grounding terminals being alternately arranged in the row direction to form terminal rows, and projections of the differential signal terminal pairs in adjacent terminal rows in a column direction perpendicular to the row direction being at least partially overlapped. A plurality of L-shaped protrusions are arranged on the conductive body and are arranged at notches of the insulating body respectively. Every two adjacent terminal rows formed a row of the L-shaped protrusions therebetween. The L-shaped protrusion includes a short edge portion and a long edge portion, a first end of the short edge portion is connected with a first end of the long edge portion, the short edge portion extends along the column direction and is electrically connected to the corresponding grounding terminal by a second end of the short edge portion, and the long edge portion extends along the row direction to isolate a part of the differential signal terminal pairs in adjacent terminal rows that are at least partially overlapped in the column direction. By such specific arrangement for the L-shaped protrusions of the electrical connector, the differential terminal pairs may be shielded well to avoid crosstalk interference, the plurality of grounding terminals are connected to each other for achieving a good common-ground effect, and meanwhile such specific distribution and configuration of the L-shaped protrusions may enhance structural stability of the corresponding insulating body.

Further, the differential signal terminal pairs in adjacent terminal rows are staggered so that a first signal terminal in the differential signal terminal pair in one terminal row and a grounding terminal in the adjacent terminal row are arranged relative to each other, and a second signal terminal in the differential signal terminal pair in the terminal row and a first signal terminal in the differential signal terminal pair in the adjacent terminal row are arranged relative to each other, thereby the relatively arranged signal terminals along the column direction form signal terminal columns. The long edge portions of the L-shaped protrusions extend through a region between the adjacent signal terminals in the signal terminal columns along the row direction. By the staggered arrangement of the terminals in adjacent terminal rows, crosstalk interference generated during a high-frequency signal transmission is avoided, adaptation to a chip and a circuit board may be implemented better, and an overall structure of the electrical connector is more stable.

Further, a second end of the long edge portion of the L-shaped protrusion extends to a position flushed with the signal terminal in the corresponding signal terminal column in the column direction. By such "flush" arrangement, the differential signal terminal pairs may be shielded well, and meanwhile the notch of the insulating body for arranging the L-shaped protrusion therein is not too large, thereby ensuring structural strength of the insulating body.

Further, the long edge portion of the L-shaped protrusion is equidistant from two adjacent terminal rows respectively. Based on this, the long edge portion of the L-shaped protrusion is arranged at a middle position between the adjacent terminal rows, so that the conductive body and the insulating body are structurally arranged more uniformly and stably.

Further, an extension height of the L-shaped protrusion in an insertion direction perpendicular to both the row direction and the column direction is consistent with a depth of the notch. The extension height of the L-shaped protrusion in the insertion direction is matched with the depth of the notch, so that the L-shaped protrusion may be matched well with the notch and engaged with the other component for common ground through the notch.

Further, extension directions of the long edge portions of two adjacent rows of the L-shaped protrusions relative to the short edge portions are opposite. Reverse arrangement of adjacent rows of the L-shaped protrusions actually depends on a staggered arrangement for the terminals, thereby achieving a good shielding effect in a most reasonable implementation manner.

Further, the short edge portions of two adjacent L-shaped protrusions in the column direction extend along the same direction, and the long edge portions of two adjacent L-shaped protrusions in the column direction extend along the opposite direction. Further, the short edge portions of two adjacent L-shaped protrusions in the row direction extend along the same direction, and the long edge portions of two adjacent L-shaped protrusions in the row direction extend along the same direction. Further, the short edge portions of two adjacent L-shaped protrusions in the row direction extend along the opposite direction, and the long edge portions of two adjacent L-shaped protrusions in the row direction extend along the opposite direction. By such arrangement for the L-shaped protrusions, the differential signal terminal pairs may be shielded well.

Further, conductive protruding blocks extending upwards are arranged on two opposite edges of the conductive body in the column direction respectively, and an extension distance of the conductive protruding block in the row direction is equal to a distance from the first end to second end of the long edge portion of the L-shaped protrusion. The conductive protruding blocks are arranged on two side edges to shield the differential signal terminal pairs in the corresponding rows to avoid interference with other circuit structure/chip on the circuit board. Meanwhile, the conductive protruding blocks may also provide a constructive interference when the conductive body is connected with the insulating body.

Further, a protruding rib is formed on the notch, and the protruding rib forms interference fit with the L-shaped protrusion. By such interference fit between the protruding rib and the L-shaped protrusion inserted into the notch, the conductive body may be connected to the insulating body more firmly.

Further, the insulating body includes a plurality of first terminal openings and a plurality of second terminal openings, the plurality of grounding terminals pass through the plurality of first terminal openings respectively, and the plurality of signal terminals pass through the plurality of second terminal openings respectively, wherein the first terminal openings are communicated with the notches respectively.

Further, the conductive body includes a plurality of third terminal openings and a plurality of fourth terminal openings, the plurality of grounding terminals pass through the plurality of third terminal openings respectively and are electrically connected with the conductive body, and the plurality of differential signal terminal pairs pass through the plurality of fourth terminal openings respectively and are disengaged from the conductive body, wherein the fourth terminal opening is a rectangular structure, a length of a short edge of the rectangular structure is not less than 1.6 mm and a length of a long edge adjacent to the short edge is not less than 2.7 mm. By such specific arrangement of opening structures in the insulating body and the conductive body, contact between the conductive body and the grounding terminals may effectively be ensured, and short-circuit caused by contact between the signal terminals and the conductive body may be prevented, so that the common-ground effect and crosstalk resistance of the electrical connector may be improved better.

BRIEF DESCRIPTION OF THE DRAWINGS

The drawings in the description are adopted to provide a further understanding to the application and constitute a part of the application. Schematic embodiments of the application and description thereof are adopted to explain the application and not intended to constitute improper limitation to the application, wherein.

DETAILED DESCRIPTION OF THE EMBODIMENTS

Figure 1:
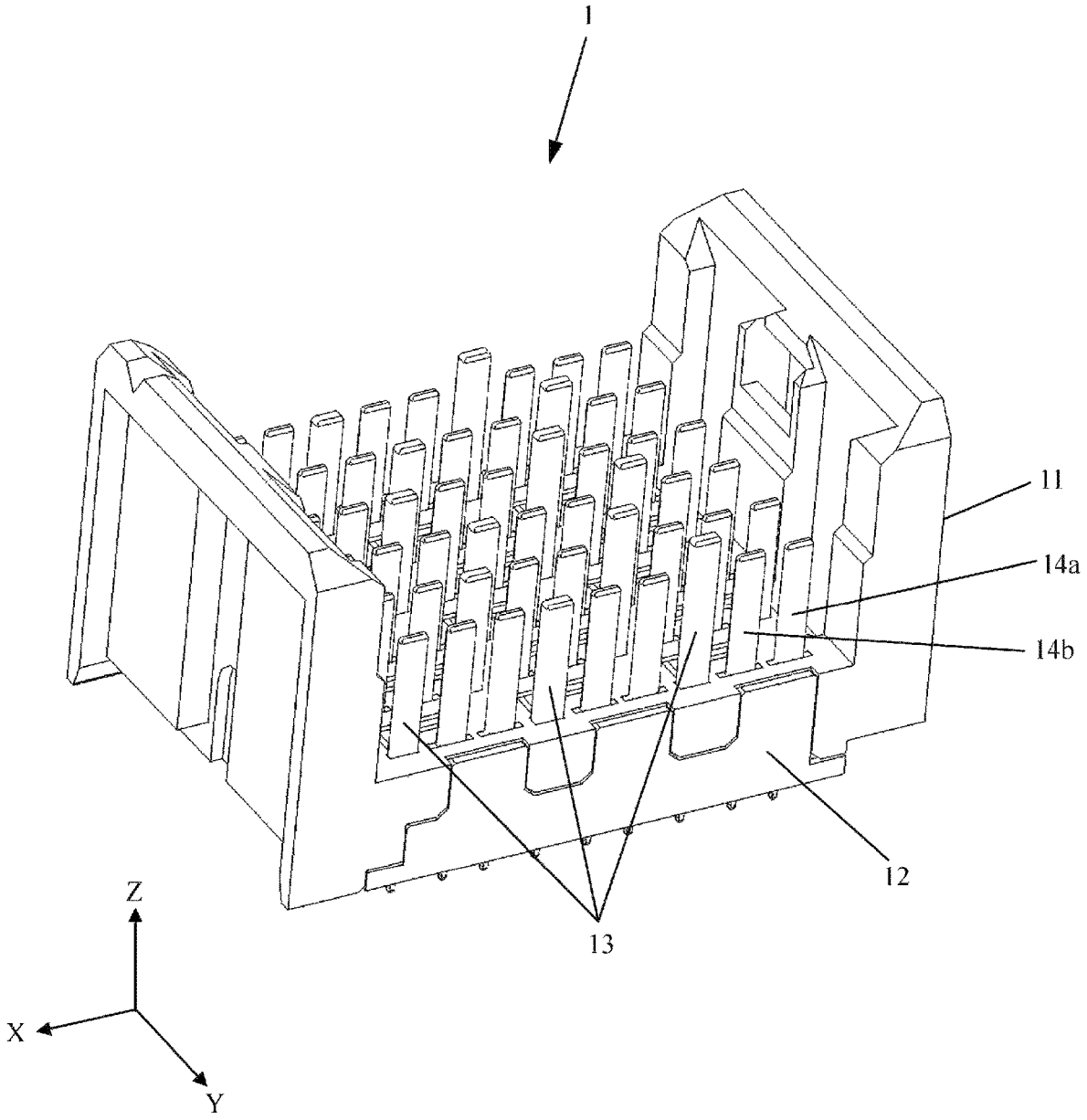
FIG. 1 is a perspective view of an electrical connector according to a first embodiment of the disclosure.

The technical solutions in the embodiments of the application will be described below in combination with the drawings in the embodiments of the application in detail. It is to be noted that the embodiments in the application and characteristics thereof may be combined without conflicts.

As shown in FIG. 1 to FIG. 4, an electrical connector 1 according to a first embodiment of the application generally includes an insulating body 11, a conductive body 12, a plurality of grounding terminals 13 and a plurality of signal terminals. The conductive body 12 is located relative to the insulating body 11, wherein the conductive body 12 is an individual component that is integrally formed and assembled and matched with the insulating body 11. Convenience for a preparation in manufacture, easiness for mass production and high replaceability are ensured. The plurality of grounding terminals 13 and the plurality of signal terminals are connected to the insulating body 11 in an array.

Every two adjacent signal terminals in a row direction X of the array form a differential signal terminal pair 14, and the differential signal terminal pairs 14 (including a first signal terminal 14*a* and a second signal terminal 14*b*) and the grounding terminals 13 are alternately arranged in the row direction X to form terminal rows. In an unlimited example shown in FIG. 1, the array includes six terminal rows and nine terminal columns, each terminal row includes three differential signal terminal pairs 14, and three grounding terminals 13 are alternately arranged between the differential terminal pairs 14. Moreover, projections of the differential signal terminal pairs 14 in adjacent terminal rows in a column direction Y perpendicular to the row direction X are at least partially overlapped. But the present disclosure does not limited thereto, in other embodiment, two differential signal terminal pairs 14 may arranged two grounding terminals 13 therebetween.

Figure 2A:
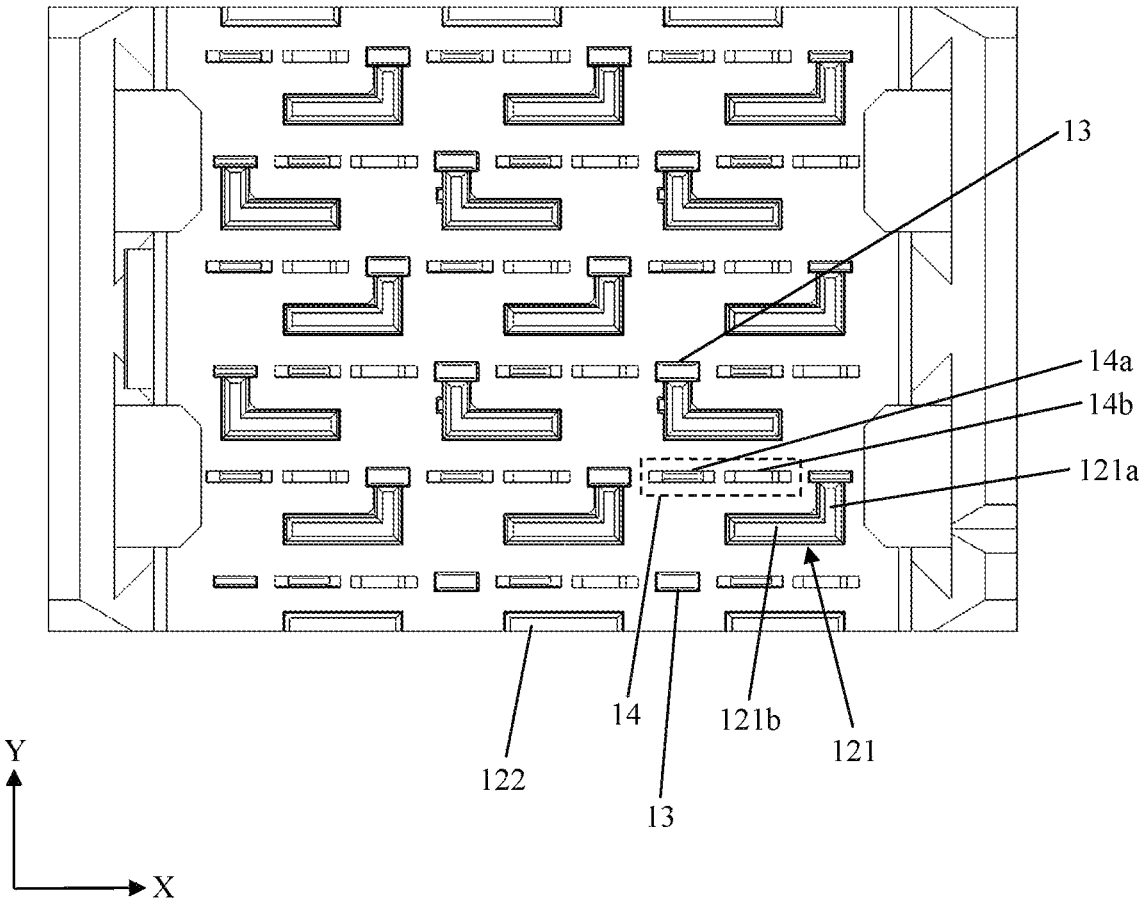
FIG. 2*a* is a top view of the electrical connector according to the first embodiment of the disclosure.
Figure 7:
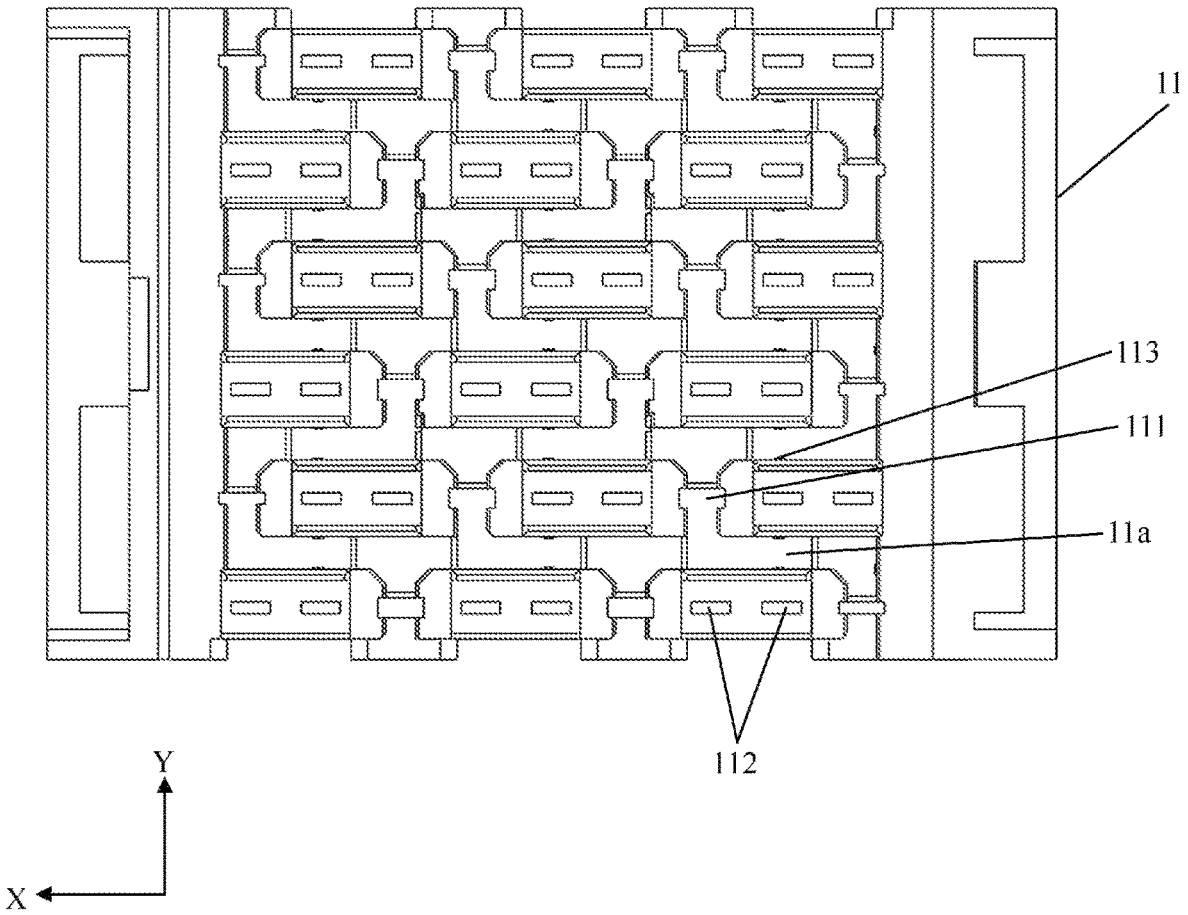
FIG. 7 is a bottom view of an insulating body of the electrical connector according to the first embodiment of the disclosure.

As shown in FIG. 2*a*, a plurality of L-shaped protrusions 121 are arranged on the conductive body 12, the L-shaped protrusions 121 are arranged in notches 11*a* of the insulating body 11 (as shown in FIG. 7) respectively, and every two adjacent terminal rows formed a row of the L-shaped protrusions therebetween. The L-shaped protrusion 121 includes a short edge portion 121*a* and a long edge portion 121*b*, a first end of the short edge portion 121*a* is connected with a first end of the long edge portion 121*b*, the short edge portion 121*a* preferably forms a right-angle connection with the long edge portion 121*b*, the short edge portion 121*a* extends along the column direction Y and is electrically connected to the corresponding grounding terminal 13 by a second end of the short edge portion 121*a*, and the long edge portion 121*b* extends along the row direction X to isolate a part of the differential signal terminal pairs 14 in adjacent terminal rows that are at least partially overlapped in the column direction Y. Preferably, one signal terminal of the differential signal terminal pair 14 is isolated.

By such a specific arrangement for the L-shaped protrusions 121 of the electrical connector, the long edge portion 121*b* extending along the row direction X is intended to isolate the part of the differential signal terminal pairs 14 in the adjacent terminal rows that are at least partially overlapped in the column direction Y, there are enough distances between the notches 11*a* in the insulating body 11 in the row direction X, thereby strength and structural stability of the insulating body 11 may be ensured. In addition, the L-shaped protrusions 121 of the conductive body 12 may also shield adjacent differential signal terminal pairs 14 in the column direction Y to avoid crosstalk interference.

As shown in FIG. 2*a*, the differential signal terminal pairs 14 in adjacent terminal rows are staggered so that the first signal terminal 14*a* in the differential signal terminal pair 14 in one terminal row and a grounding terminal 13 in the adjacent terminal row are arranged relative to each other, and the second signal terminal 14*b* in the differential signal terminal pair 14 in the terminal row and the first signal terminal 14*a* in the differential signal terminal pair 14 in the adjacent terminal row are arranged relative to each other, thereby the relatively arranged terminals along the column direction Y form signal terminal columns. That is, as shown in FIG. 2*a*, if the leftmost signal terminal column is a first signal terminal column and the rightmost signal terminal column is a ninth signal terminal column, the first signal terminals 14*a* and the grounding terminals are alternately arranged along the column direction Y in the first signal terminal column, and the second signal terminals 14*b* and the first signal terminals 14*a* are alternately arranged along the column direction Y in a second signal terminal column.

The terminals in adjacent terminal rows are staggered, so that crosstalk interference generated during a high-frequency signal transmission may further be reduced or avoided, adaptation to a chip and a circuit board may be implemented better, and slots or openings in the insulating body may be scattered as much as possible to reduce structural weak links so that an overall structure of the electrical connector becomes more stable.

As shown in FIG. 2*a*, the long edge portions 121*b* of the L-shaped protrusions 121 may respectively extend through a region between the adjacent signal terminals in the signal terminal columns along the row direction X. That is, the long edge portions 121*b* of the L-shaped protrusions 121 are configured to respectively extend to a region between the second signal terminals 14*b* and first signal terminals 14*a* in the signal terminal columns where the second signal terminals 14*b* and the first signal terminals 14*a* are alternately arranged along the column direction Y.

By such arrangement, in the row direction X, adjacent differential signal terminal pairs 14 in the terminal rows are spaced and shielded by the grounding terminals 13; and in the column direction Y, one side of the first signal terminal 14*a* in each differential signal terminal pair 14 is shielded by the grounding terminal 13, while the other side is shielded by the grounding terminal 13 and the L-shaped protrusion 121, and both sides of the second signal terminals 14*b* in the differential signal terminal pair 14 are shielded by the long edge portions 121*b* of the L-shaped protrusions 121. As such, any two adjacent signal terminal pairs 14 may be shielded, thereby the crosstalk generated during a signal transmission of the electrical connector may be prevented or reduced.

Preferably, a second end of the long edge portion 121*b* of the L-shaped protrusion 121 may extend to a position flushed with the signal terminal in the corresponding signal terminal column in the column direction Y. That is, as shown in FIG. 2*a*, the long edge portion 121*b* of the L-shaped protrusion 121 may extend in the region between the second signal terminal 14*b* (on one side) and the first signal terminal 14*a* (on the other side) of the same signal terminal column. An edge of the long edge portion is flushed with edges of the second signal terminal 14*b* and the first signal terminal 14*a* along the column direction Y (namely flushed with an imaginary flush line extending along the column direction Y).

By such a "flush" arrangement for the long edge portions 121*b* of the L-shaped protrusions 121, the differential signal terminal pairs 14 may be shielded well, meanwhile the notch 11*a* of the insulating body 11 for arranging the L-shaped protrusion 121 therein is not too large for ensuring structural strength of the insulating body 11.

From FIG. 2*a*, it can also be seen that, in the embodiment, the long edge portion 121*b* of the L-shaped protrusion 121 may equidistant from two adjacent terminal rows respectively. As such, the long edge portion 121*b* of the L-shaped protrusion 121 is arranged at a middle position between the adjacent terminal rows, so that the conductive body 12 and the insulating body 11 are structurally arranged more uniformly and stably. In addition, an extension height of the L-shaped protrusion 121 in an insertion direction Z perpendicular to both the row direction X and the column direction Y may be configured to be consistent with a depth of the notch 11*a*. Therefore, the shielding of the signal terminal pairs 14 by the L-shaped protrusions 121 in the insulating body 11 may be ensured, and influence on connection and shielding between each of the grounding terminals 13 and signal terminal pairs 14 on the electrical connector and other connected components may be eliminated.

As shown in FIG. 2*a*, extension directions of the long edge portions 121*b* of two adjacent rows of the L-shaped protrusions 121 relative to the short edge portions 121*a* are opposite. In FIG. 2*a*, the long edge portions 121*b* of the bottom row of the L-shaped protrusions 121 each extend leftwards relative to the short edge portions 121*a*, and the long edge portions 121*b* of the L-shaped protrusions in the adjacent row above each extend rightwards relative to the short edge portions 121*a*.

The short edge portions 121*a* of two adjacent L-shaped protrusions 121 in the column direction Y may extend along the same direction, and the long edge portions 121*b* of two adjacent L-shaped protrusions 121 in the column direction Y may extend along the opposite direction.

The short edge portions 121*a* of two adjacent L-shaped protrusions 121 in the row direction X may extend along the same direction, and the long edge portions 121*b* of two adjacent L-shaped protrusions 121 in the row direction X may extend along the same direction.

By such an arrangement, a good shielding effect may be achieved, and the structural strength of the insulating body 11 may favorably be ensured.

Figure 2B:
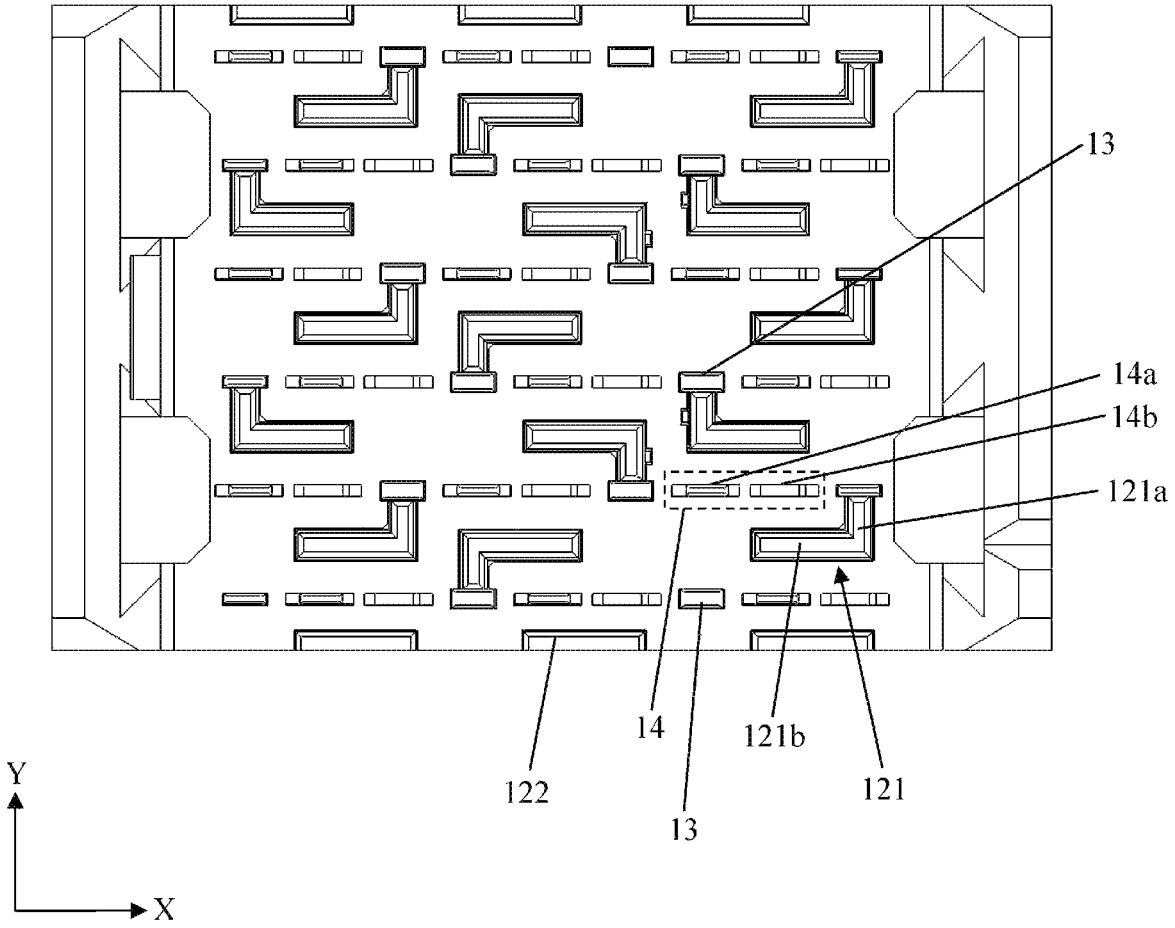
FIG. 2*b* is a top view of the electrical connector according to the first embodiment of the disclosure, showing another arrangement for L-shaped protrusions.

FIG. 2*b* illustrates another arrangement for the L-shaped protrusions 121. The difference between the L-shaped protrusions 121 shown in FIG. 2*a* and that shown in FIG. 2*b* is that the short edge portions 121*a* of two adjacent L-shaped protrusions 121 in the row direction X extend along the opposite direction and the long edge portions 121*b* of two adjacent L-shaped protrusions 121 in the row direction X extend along the opposite direction. By such an arrangement, a good shielding effect may also be achieved.

Figure 3:
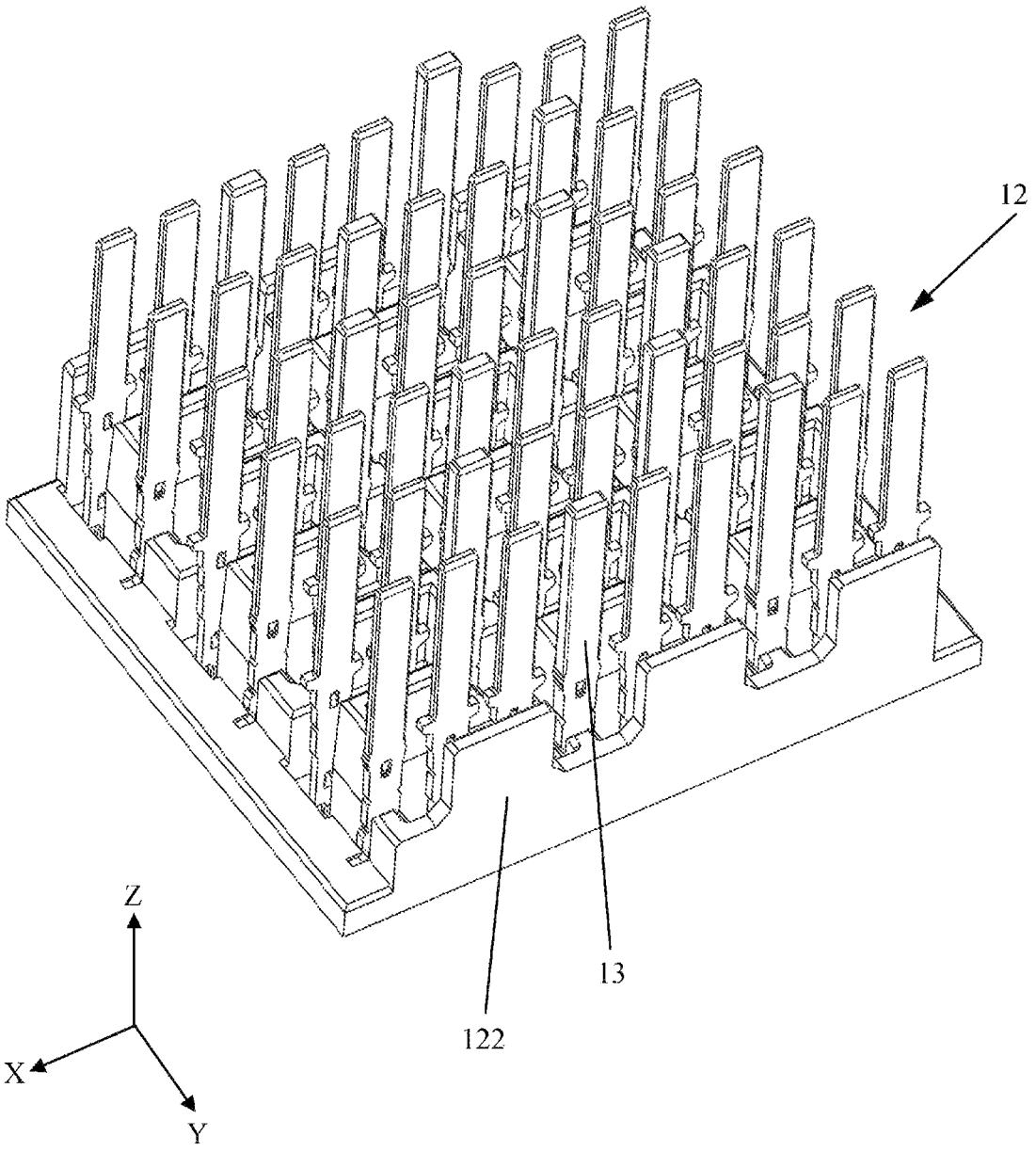
FIG. 3 is a perspective view of a conductive body of the electrical connector according to the first embodiment of the disclosure, wherein grounding terminals have been connected to the conductive body.
Figure 4:
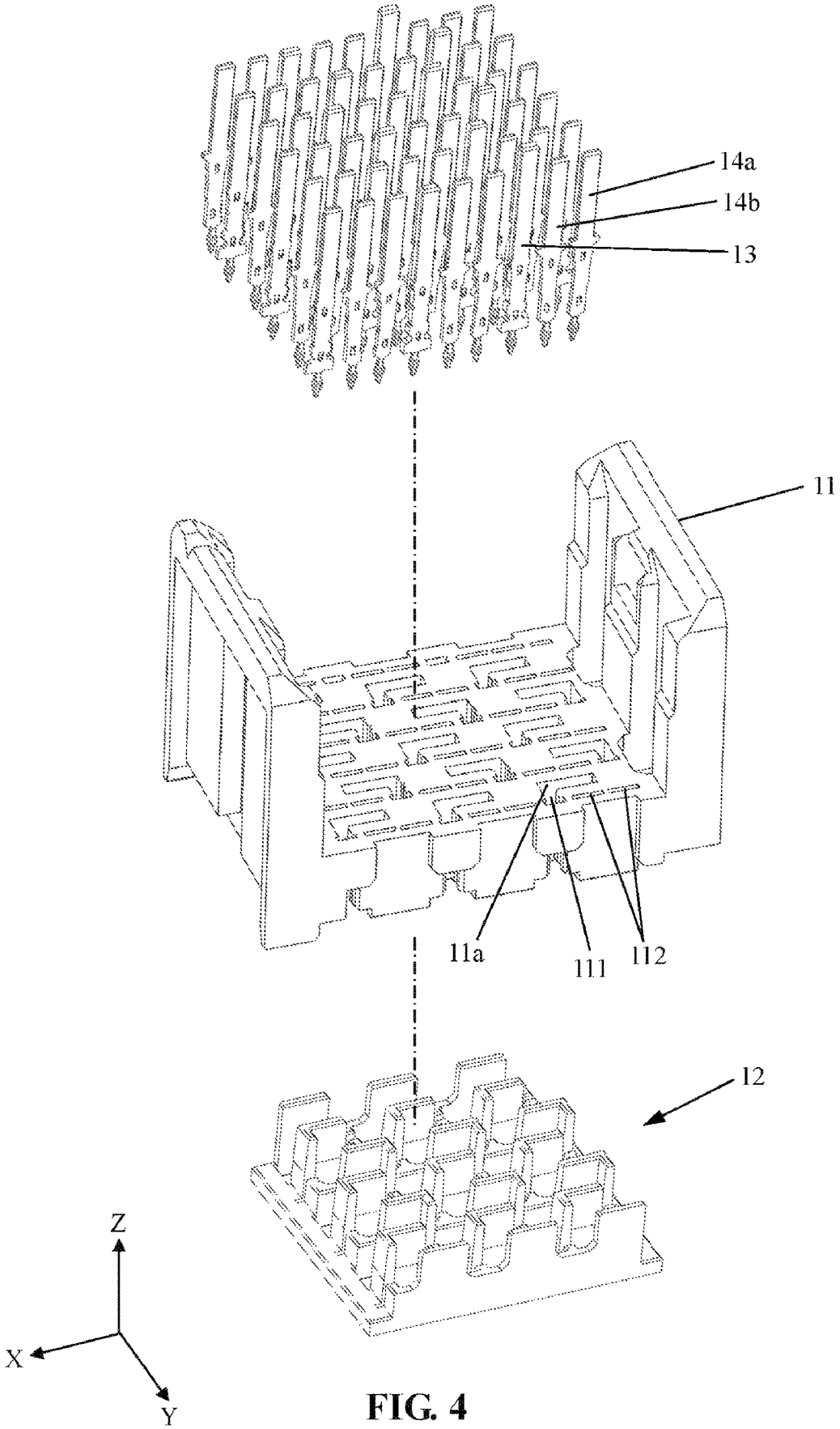
FIG. 4 is a perspective view of the electrical connector in FIG. 1 in a disassembled state.

As shown in FIG. 2*a* and FIG. 3, conductive protruding blocks 122 extending upwards are arranged on two opposite edges of the conductive body 12 in the column direction Y respectively, and an extension distance of the conductive protruding block 122 in the row direction X is equal to a distance from the first end to second end of the long edge portion 121*b* of the L-shaped protrusion 121, so that the differential signal terminal pairs 14 in the corresponding rows are shielded to avoid interference with other circuit structure/chip on the circuit board. Meanwhile, the conductive protruding blocks 122 may also provide a constructive interference when the conductive body 12 is connected with the insulating body 11 (for example, the conductive protruding blocks 122 on the conductive body 12 may form interference fit with the corresponding matched notches in the insulating body 11) to reduce or avoid the risk of separation of the conductive body 12 from the insulating body 11.

Figure 8A:
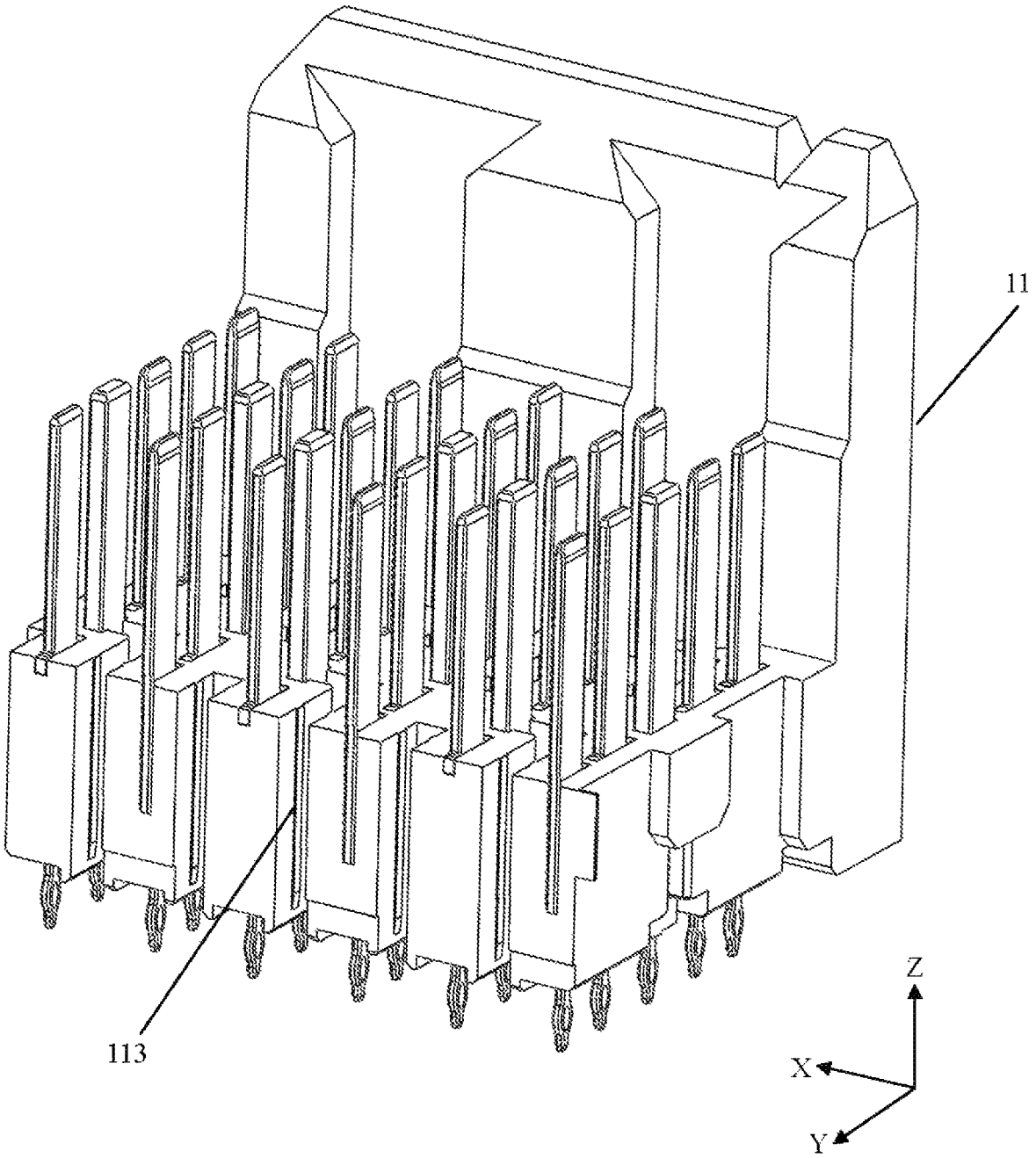
FIG. 8*a* and FIG. 8*b* are partial sectional perspective views of the insulating body of an electrical connector according to the disclosure.
Figure 8B:
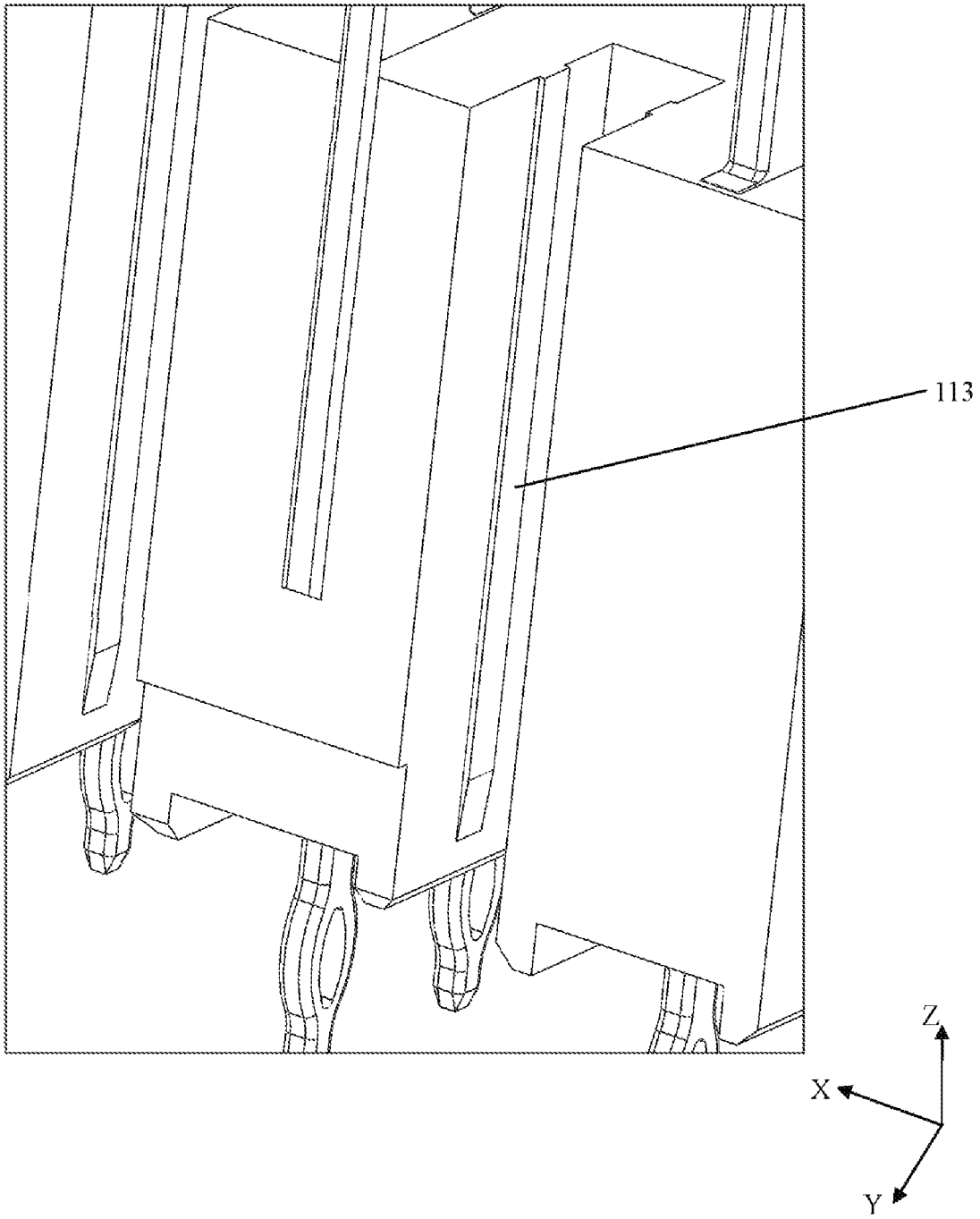

As shown in FIG. 7, FIG. 8*a* and FIG. 8*b*, a protruding rib 113 may be formed on the notch 11*a*, and the protruding rib 113 forms interference fit with the L-shaped protrusion 121 (for conveniently showing the protruding rib 113, the L-shaped protrusion 121 is not shown in FIG. 7, FIG. 8*a* and FIG. 8*b*), so that connection stability of the conductive body 12 and the insulating body 11 is enhanced. Such interference fit may be hard interference, that is, at least one protruding rib 113 is formed on an inner surface of the notch 11*a*, and a corresponding lateral surface of the corresponding L-shaped protrusion 121 is flat, and when the L-shaped protrusion 121 is inserted into the notch 11*a*, the L-shaped protrusion 121 is firmly clamped into the notch 11*a* by the protruding rib 113.

As shown in FIG. 8*a* and FIG. 8*b*, the protruding rib 113 on the notch 11*a* linearly extends along the insertion direction Z, and a thickness of at least part of the protruding rib 113 may gradually decrease from top to bottom along the insertion direction Z to form a guide section, so that, when the conductive body 12 is inserted into the insulating body 11 from below shown in FIG. 8*a*, a part of the protruding rib with a relatively small thickness at the lower portion may conveniently guide the insertion of the L-shaped protrusion 121 and provide a gradually enhanced clamping effect along with increase of an insertion depth thereof. However, the disclosure is not limited thereto. In an alternative solution, a fit manner for the L-shaped protrusion 121 and the notch 11*a* may be concave-convex fit or other equivalent means to achieve the effect of fixing the two.

As shown in FIG. 7, the insulating body 11 includes a plurality of first terminal openings 111 and a plurality of second terminal openings 112, the plurality of grounding terminals 13 pass through the plurality of first terminal openings 111 respectively, and the plurality of signal terminals (including the first signal terminals 14*a* and the second signal terminals 14*b*) pass through the plurality of second terminal openings 112 respectively, wherein the first terminal openings 111 are communicated with the notches 11*a* respectively, so that when the L-shaped protrusions 121 are inserted into the notches 11*a*, the short edge portions 121*a* of the L-shaped protrusions 121 may be electrically connected with the grounding terminals 13.

Figure 5:
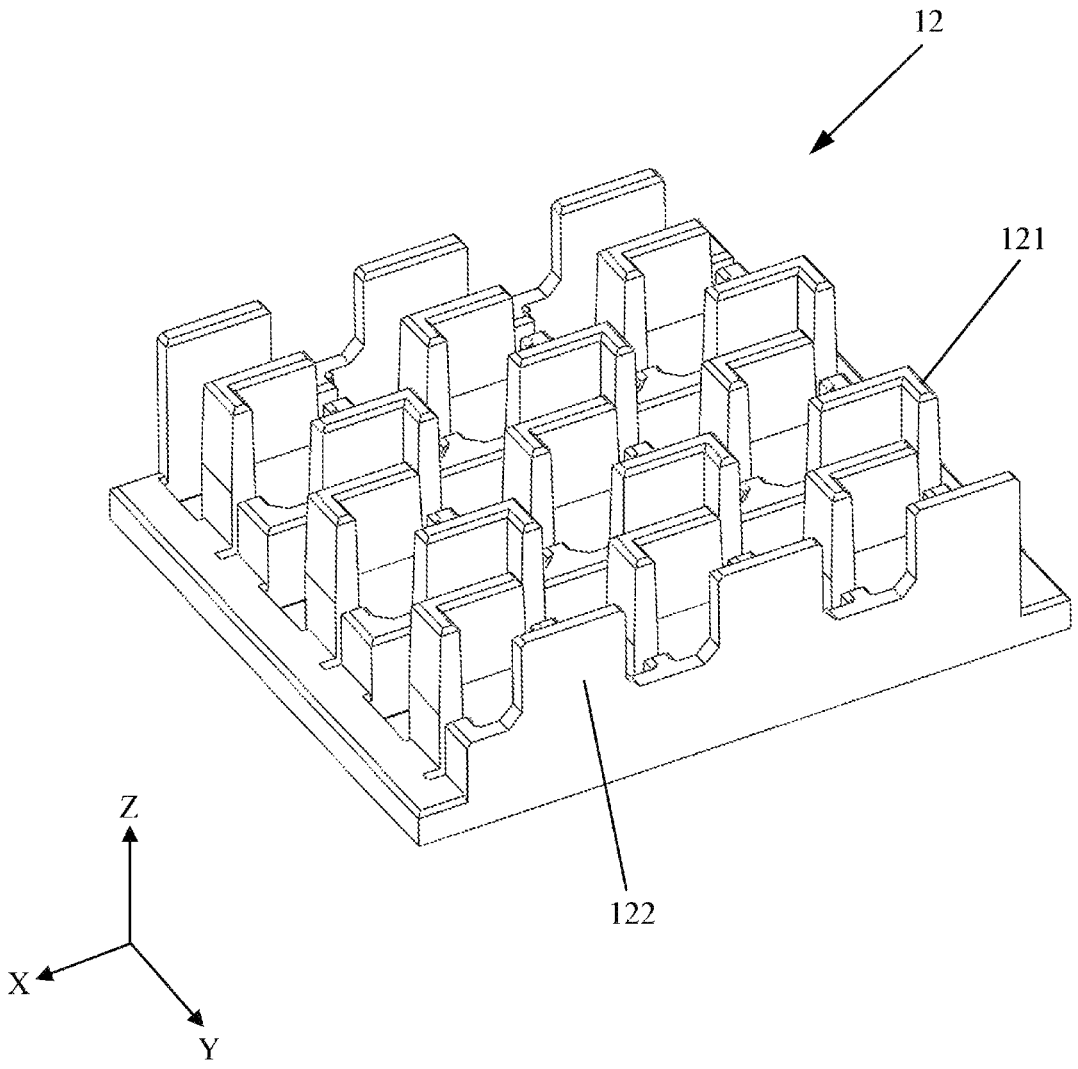
FIG. 5 is a perspective view of the conductive body of the electrical connector according to the first embodiment of the disclosure.
Figure 6:
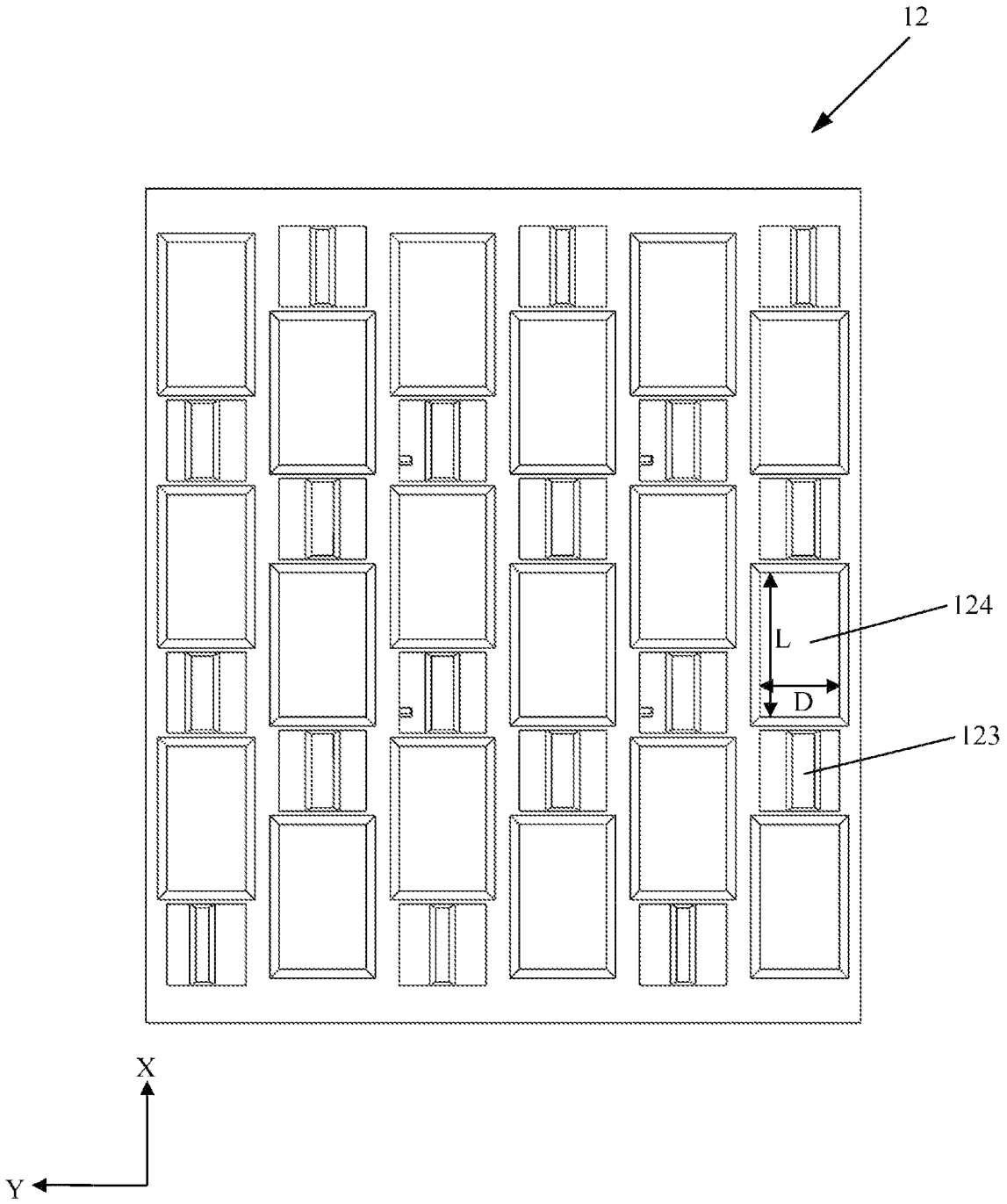
FIG. 6 is a bottom view of the conductive body of the electrical connector according to the first embodiment of the disclosure.

As shown in FIG. 5 and FIG. 6, the conductive body 12 includes a plurality of third terminal openings 123 and a plurality of fourth terminal openings 124, the plurality of grounding terminals 13 pass through the plurality of third terminal openings 123 respectively and are electrically connected with the conductive body 12, and the plurality of differential signal terminal pairs 14 pass through the plurality of fourth terminal openings 124 respectively and are disengaged from the conductive body 12, wherein the fourth terminal opening 124 is a rectangular structure, a length D of a short edge of the rectangular structure is not less than 1.6 mm and a length L of a long edge adjacent to the short edge is not less than 2.7 mm.

Figure 9:
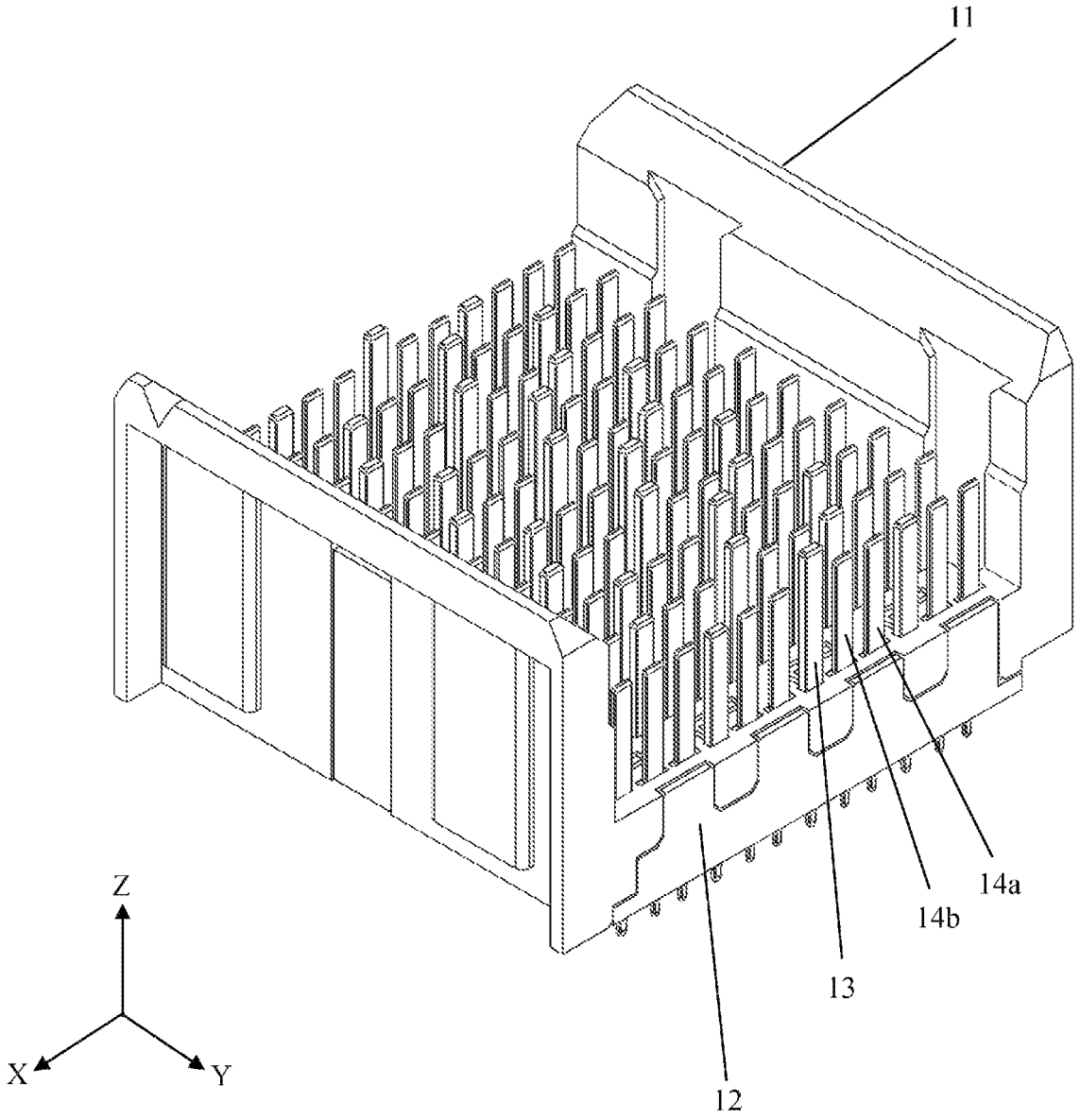
FIG. 9 is a perspective view of an electrical connector according to a second embodiment of the disclosure.

FIG. 9 illustrates an electrical connector according to a second embodiment of the disclosure. An arrangement thereof is substantially same as the arrangement for the first electrical connector shown in FIG. 1 to FIG. 8*b*, one difference therebetween is the electrical connector according to the second embodiment including ten terminal rows and twelve terminal columns, and the assembling manner for the conductive body is also different.

Figure 10:
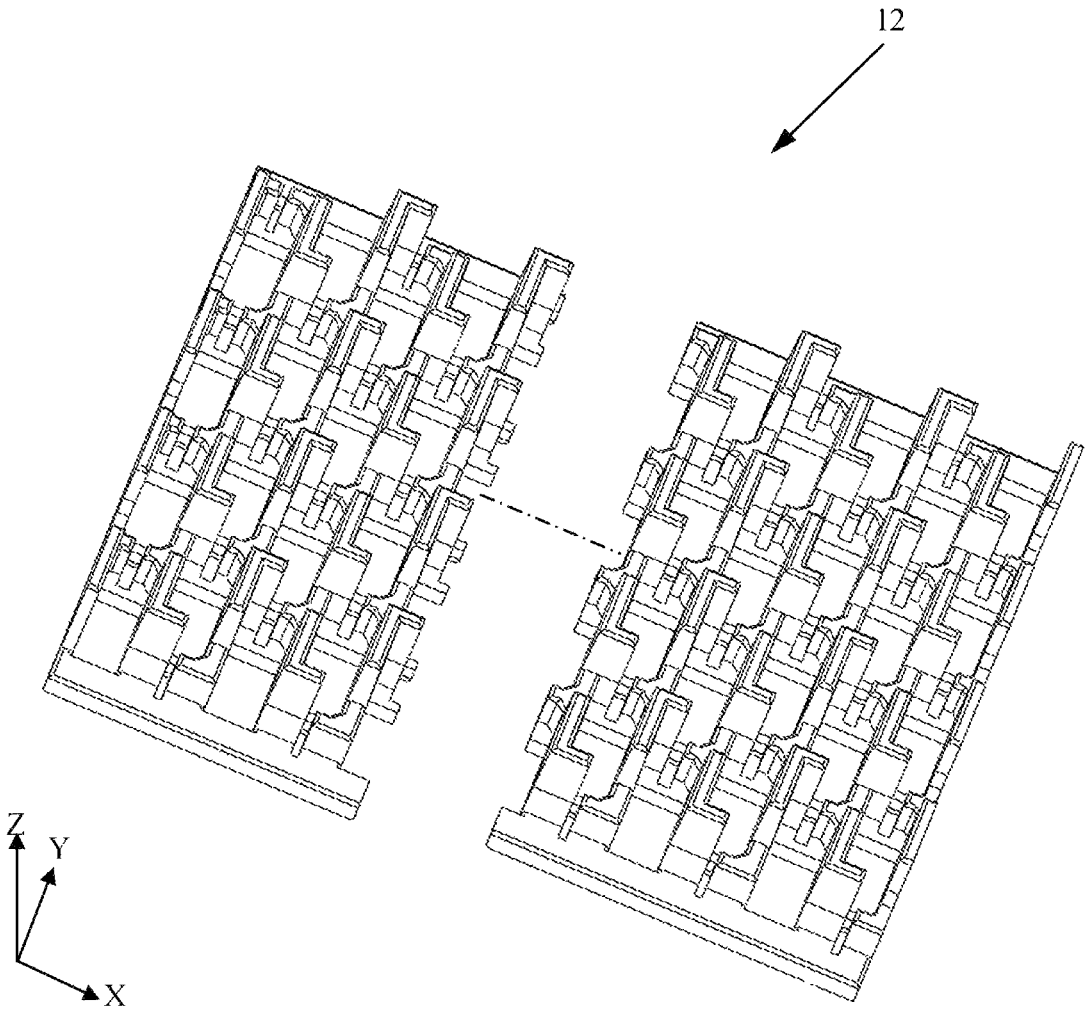
FIG. 10 is a perspective view of a conductive body of the electrical connector according to the second embodiment of the disclosure, wherein the conductive body is a two-piece structure.

As shown in FIG. 10, the conductive body of the electrical connector in each embodiment of the disclosure may be of a split structure, for example, may adopt a two-piece structure shown in FIG. 10, which consists of two half portions electrically connected together. For an electrical connector with a large size due to relatively large numbers of grounding terminals and signal terminals, such two-piece structure (split structure) is convenient to manufacture.

In the application, the conductive body 12 may be made from a wave absorbing material, an electrically lossy material or the like, and the electrically lossy material is formed by adding a filler including a conductive particle into a binder. Examples of the conductive particle capable of forming the electrically lossy material as the filler may include a carbon or graphite in a fiber or sheet form, or other particle form. Metal in powder, sheet, fiber or other particle form may also be used for providing a proper electrical loss characteristic. Optionally, a combination of fillers may be used. For example, a metal-plated carbon particle may be used. Silver and nickel are proper plated metals for fibers. A coated particle may be used independently or combined with a filler of another fiber such as a carbon sheet for use.

In some embodiments, a binder may be a thermoplastic material and a high-temperature-resistant nylon material, and is for example routinely used for manufacturing the electrical connector to die-cast the electrically lossy material into an expected shape and position as part of manufacturing of the electrical connector. However, binder materials in many optional forms may be used. A curable material such as an epoxy resin may also be used as the binder. Optionally, a material such as a thermoplastic resin or adhesive may be used. Moreover, although the above-described binder material forms the binder surrounding the conductive particle filler to create the electrically lossy material, the application is not limited thereto. For example, according to another solution for the conductive body, the thermoplastic material or high-temperature-resistant nylon material routinely for manufacturing the electrical connector may also be injection-molded at first and then metal-plated with a conductive material such as copper, nickel, gold and silver.

The above is only the preferred embodiment of the application and not intended to limit the application. For those skilled in the art, the application may have various modifications and variations. Any modifications, equivalent replacements, improvements and the like made within the spirit and principle of the application shall fall within the scope of protection of the application.

What is claimed is:

1. An electrical connector, comprising:

an insulating body;

a conductive body, located relative to the insulating body; and a plurality of grounding terminals and a plurality of signal terminals connected to the insulating body in an array, wherein every two adjacent signal terminals in a row direction of the array form a differential signal terminal pair, the differential signal terminal pairs and the grounding terminals being alternately arranged in the row direction to form terminal rows, and projections of the differential signal terminal pairs in adjacent terminal rows in a column direction perpendicular to the row direction being at least partially overlapped, wherein a plurality of L-shaped protrusions are arranged on the conductive body and are arranged in notches of the insulating body respectively, every two adjacent terminal rows formed a row of the L-shaped protrusions therebetween; wherein the L-shaped protrusion comprises a short edge portion and a long edge portion, a first end of the short edge portion is connected with a first end of the long edge portion, the short edge portion extends along the column direction and is electrically connected to the corresponding grounding terminal by a second end of the short edge portion, and the long edge portion extends along the row direction to isolate a part of the differential signal terminal pairs in adjacent terminal rows that are at least partially overlapped in the column direction, wherein the conductive body is integrally formed.

2. The electrical connector as claimed in claim 1, wherein the differential signal terminal pairs in adjacent terminal rows are staggered so that a first signal terminal in the differential signal terminal pair in one terminal row and a grounding terminal in the adjacent terminal row are arranged relative to each other, and a second signal terminal in the differential signal terminal pair in the terminal row and a first signal terminal in the differential signal terminal pair in the adjacent terminal row are arranged relative to each other, thereby the relatively arranged signal terminals along the column direction form signal terminal columns; and the long edge portions of the L-shaped protrusions extend through a region between the adjacent signal terminals in the signal terminal columns along the row direction.

3. The electrical connector as claimed in claim 2, wherein a second end of the long edge portion of the L-shaped protrusion extends to a position flushed with the signal terminal in the corresponding signal terminal column in the column direction.

4. The electrical connector as claimed in claim 1, wherein the long edge portion of the L-shaped protrusion is equidistant from two adjacent terminal rows respectively.

5. The electrical connector as claimed in claim 1, wherein an extension height of the L-shaped protrusion in an insertion direction perpendicular to both the row direction and the column direction is consistent with a depth of the notch.

6. The electrical connector as claimed in claim 1, wherein extension directions of the long edge portions of two adjacent rows of the L-shaped protrusions relative to the short edge portions are opposite.

7. The electrical connector as claimed in claim 1, wherein the short edge portions of two adjacent L-shaped protrusions in the column direction extend along the same direction, and the long edge portions of two adjacent L-shaped protrusions in the column direction extend along the opposite direction.

8. The electrical connector as claimed in claim 7, wherein the short edge portions of two adjacent L-shaped protrusions in the row direction extend along the same direction, and the long edge portions of two adjacent L-shaped protrusions in the row direction extend along the same direction.

9. The electrical connector as claimed in claim 7, wherein the short edge portions of two adjacent L-shaped protrusions in the row direction extend along the opposite direction, and the long edge portions of two adjacent L-shaped protrusions in the row direction extend along the opposite direction.

10. The electrical connector as claimed in claim 1, wherein conductive protruding blocks extending upwards are arranged on two opposite edges of the conductive body in the column direction respectively, the conductive protruding blocks are arranged relative to the differential signal terminal pairs in adjacent terminal rows, and an extension distance thereof in the row direction is equal to a distance from the first end to second end of the long edge portion of the L-shaped protrusion.

11. The electrical connector as claimed in claim 1, wherein a protruding rib is formed on the notch, and the protruding rib forms interference fit with the L-shaped protrusion.

12. The electrical connector as claimed in claim 1, wherein the insulating body comprises a plurality of first terminal openings and a plurality of second terminal openings, the plurality of grounding terminals pass through the plurality of first terminal openings respectively, and the plurality of signal terminals pass through the plurality of second terminal openings respectively, wherein the first terminal openings are communicated with the notches respectively.

13. The electrical connector as claimed in claim 1, wherein the conductive body comprises a plurality of third terminal openings and a plurality of fourth terminal openings, the plurality of grounding terminals pass through the plurality of third terminal openings respectively and are electrically connected with the conductive body, and the plurality of differential signal terminal pairs pass through the plurality of fourth terminal openings respectively and are disengaged from the conductive body, wherein the fourth terminal opening is a rectangular structure, a length of a short edge of the rectangular structure is not less than 1.6 mm and a length of a long edge adjacent to the short edge is not less than 2.7 mm.

14. An electrical connector, comprising:

an insulating body;

a conductive body, located relative to the insulating body; and a plurality of grounding terminals and a plurality of signal terminals connected to the insulating body in an array, wherein every two adjacent signal terminals in a row direction of the array form a differential signal terminal pair, the differential signal terminal pairs and the grounding terminals being alternately arranged in the row direction to form terminal rows, and projections of the differential signal terminal pairs in adjacent terminal rows in a column direction perpendicular to the row direction being at least partially overlapped, wherein a plurality of L-shaped protrusions are arranged on the conductive body and are arranged in notches of the insulating body respectively, every two adjacent terminal rows formed a row of the L-shaped protrusions therebetween; wherein the L-shaped protrusion comprises a short edge portion and a long edge portion, a first end of the short edge portion is connected with a first end of the long edge portion, the short edge portion extends along the column direction and is electrically connected to the corresponding grounding terminal by a second end of the short edge portion, and the long edge portion extends along the row direction to isolate a part of the differential signal terminal pairs in adjacent terminal rows that are at least partially overlapped in the column direction, wherein the conductive body comprises a plurality of third terminal openings and a plurality of fourth terminal openings, the plurality of grounding terminals pass through the plurality of third terminal openings respectively and are electrically connected with the conductive body, and the plurality of differential signal terminal pairs pass through the plurality of fourth terminal openings respectively and are disengaged from the conductive body.

15. The electrical connector as claimed in claim 14, wherein the differential signal terminal pairs in adjacent terminal rows are staggered so that a first signal terminal in the differential signal terminal pair in one terminal row and a grounding terminal in the adjacent terminal row are arranged relative to each other, and a second signal terminal in the differential signal terminal pair in the terminal row and a first signal terminal in the differential signal terminal pair in the adjacent terminal row are arranged relative to each other, thereby the relatively arranged signal terminals along the column direction form signal terminal columns; and the long edge portions of the L-shaped protrusions extend through a region between the adjacent signal terminals in the signal terminal columns along the row direction.

16. The electrical connector as claimed in claim 15, wherein a second end of the long edge portion of the L-shaped protrusion extends to a position flushed with the signal terminal in the corresponding signal terminal column in the column direction.

17. The electrical connector as claimed in claim 14, wherein the short edge portions of two adjacent L-shaped protrusions in the column direction extend along the same direction, and the long edge portions of two adjacent L-shaped protrusions in the column direction extend along the opposite direction.

18. The electrical connector as claimed in claim 17, wherein the short edge portions of two adjacent L-shaped protrusions in the row direction extend along the same direction, and the long edge portions of two adjacent L-shaped protrusions in the row direction extend along the same direction, or the short edge portions of two adjacent L-shaped protrusions in the row direction extend along the opposite direction, and the long edge portions of two adjacent L-shaped protrusions in the row direction extend along the opposite direction.

19. The electrical connector as claimed in claim 14, wherein the insulating body comprises a plurality of first terminal openings and a plurality of second terminal openings, the plurality of grounding terminals pass through the plurality of first terminal openings respectively, and the plurality of signal terminals pass through the plurality of second terminal openings respectively, wherein the first terminal openings are communicated with the notches respectively.

20. The electrical connector as claimed in claim 14, wherein the fourth terminal opening is a rectangular structure, a length of a short edge of the rectangular structure is not less than 1.6 mm and a length of a long edge adjacent to the short edge is not less than 2.7 mm.

* * * * *